US005857593A

United States Patent [19]

Patronaggio

[11] Patent Number: 5,857,593

[45] Date of Patent: Jan. 12, 1999

[54] COLLAPSIBLE FLEXIBLE TUBE SQUEEZING DEVICE

[75] Inventor: Cal Patronaggio, Sierra Vista, Ariz.

[73] Assignee: David A. Clark, Temecula, Calif.; a part interest

[21] Appl. No.: 839,749

[22] Filed: Apr. 15, 1997

[51] Int. Cl.[6] ..... B65D 35/28

[52] U.S. Cl. ..... 222/103

[58] Field of Search ..... 222/92, 95, 103

[56] References Cited

U.S. PATENT DOCUMENTS

| | | | |
|---|---|---|---|
| D. 338,124 | 8/1993 | Eatherly | D6/541 |
| D. 363,629 | 10/1995 | Bost | D6/541 |
| 2,083,603 | 6/1937 | Harwick | 221/60 |
| 3,248,012 | 4/1966 | Adams | 222/95 |
| 4,159,787 | 7/1979 | Wright | 222/103 |
| 4,778,082 | 10/1988 | Vitelle | 222/95 |
| 4,928,851 | 5/1990 | Eatherly | 222/103 |
| 4,976,380 | 12/1990 | von Schuckmann | 222/103 |
| 5,071,036 | 12/1991 | Kelly et al. | 222/103 |
| 5,167,348 | 12/1992 | Okami et al. | 222/103 |
| 5,222,629 | 6/1993 | Tal | 222/103 |

FOREIGN PATENT DOCUMENTS

| | | |
|---|---|---|
| 1482872 | 4/1967 | France . |
| 3639365 | 5/1988 | Germany . |
| 506861 | 12/1954 | Italy . |

*Primary Examiner*—Joseph A. Kaufman
*Attorney, Agent, or Firm*—James G. O'Neill

[57] ABSTRACT

A flexible device for efficiently emptying the viscous contents of a flexible, plastic tube having a longitudinal, overlapping, sealed seam. The flexible device is a generally planar, elongated body having a slot of shorter length extending entirely through the body. The slot has a wider entrance and tapers to a narrower exit to allow an embossed, flattened and sealed end of the plastic, flexible, walled tube to be inserted, and to enable the flexible device to be pushed along the plastic, flexible, walled tube and to have the slot of the device stay in position by a spring-like, clamping action of the slot with the knife-like scrapping rear edge, gripping the flattened flexible wall tube.

6 Claims, 1 Drawing Sheet

COLLAPSIBLE FLEXIBLE TUBE SQUEEZING DEVICE

BACKGROUND OF THE INVENTION

1. Field of the Invention

This invention relates generally to devices for expelling materials from tubes and, more particularly, to a resilient device for expelling viscous material from plastic, flexible walled tubes having overlapping, longitudinal, sealed seams creating a ridge thereon.

2. Description of the Related Art

As is well known, many types of viscous materials, such as gels, liquids, pastes, and the like, are sold in flexible tubes having one sealed end and a narrow nozzle end and having a closure means, such as a valve or cap thereon. These tubes may be made from many materials, but presently the majority of them are made from flexible plastic. The viscous material to be dispensed from the flexible tube is generally inserted in one end, and this end is then sealed to normally sealed to form an embossed, flattened end seal. It is also well known that such tubes do not efficiently expel all of the various materials held therein, and numerous attempts have been made to solve this problem.

Known means include slide members, squeezing members and ratcheting members. Many types of squeezing or extruding devices, have been proposed and used to aid in the expelling of viscous material from flexible tubes. Such known means, work well in some situations, but are not adaptable for all uses and in all situations. Therefore, there still exists the need in the art for an improved means for aiding and dispensing of all the viscous material held in modern flexible, plastic tubes.

SUMMARY OF THE INVENTION

Accordingly, it is a general object of the present invention to provide an improved means for dispensing viscous material from a collapsible tube. It is a particular object of the present invention to provide an improved slider to aid in dispensing a viscous material from a resilient collapsible tube. It is a still more particular object of the present invention to provide an improved slider device which is flexible to efficiently dispense viscous material from a plastic, flexible, collapsible tube having a seam thereon. It is yet a more particular object of the present invention to provide an improved device for emptying flexible, plastic tubes having a seam thereon, which device has a slot with a narrow portion and which device is made from a resilient material allowing the slot to expand upon being slid on to such a flexible tube.

In accordance with one aspect of the present invention, there is provided a device for aiding the dispensing of a viscous material, such as a liquid, paste or gel, from a flexible, thin, walled, plastic tube having one flattened and one sealed end. The device has a generally planar, elongated body with a slot of shorter length formed through the device. The slot has a wider entrance into the elongated body allowing easy insertion of the flattened and sealed end of the flexible tube into the slot. The slot then narrows to a width substantially equal to the thickness of the flattened, flexible, plastic tube.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION

Figure 1:
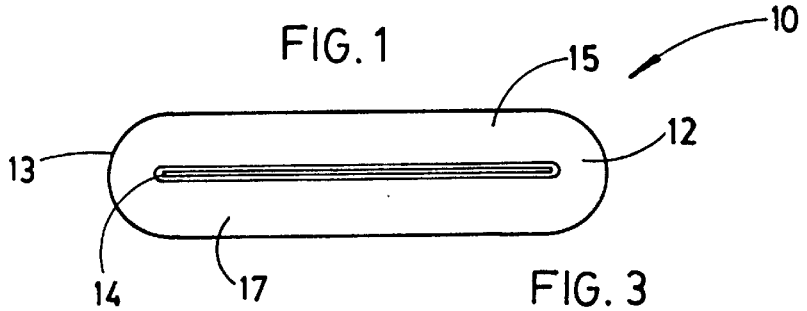
FIG. 1 is a front elevational view of the preferred embodiment of a flexible, dispensing aid of the present invention.
Figure 2:
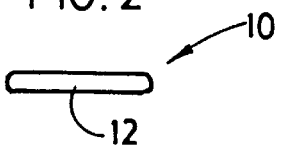
FIG. 2 is an end elevational view of FIG. 1.

The following description is provided to enable any person skilled in the art to make and use the invention and, sets forth the best modes contemplated by the inventor of carrying out his invention. Various modifications, however, will remain readily apparent to those skilled in the art, since the generic principles of the present invention have been defined herein, specifically to provide for an explanation of a novel and unique flexible device 10 for aiding in the dispensing of a viscous material, such as a toothpaste, gel, liquid, or any other similar type material held in a flexible tube.

As shown in the drawings, the device 10 preferably includes a substantially elongated, flat planar body or member, approximately one eight of an inch thick, between about ⅝ of an inch and ¾ of an inch wide, and from between about 2¾ inches and 2 15/16 inches long. The body preferably has rounded ends 12 and 13, with a slot 14 formed therein. The slot has a length that is shorter than the length of the body, and adapted to fit a flexible plastic tube that is approximately 2 5/16 inches wide, in a flattened position. Therefore, the slot is preferably approximately 2 and ⅜ of an inch long and is bounded by side edges 15 and 17, and the ends 12 and 13.

The device 10 may be made from any flexible material, such as a flexible or resilient plastic, to allow the slot 14 to flex or spread, particularly toward the center thereof. That is, the side edges 15 and 17 are sufficiently long, and have sufficient resilience that at least the central portion of the slot will be able to flex or spread outwardly a predetermined distance, toward the side edges.

Figure 3:
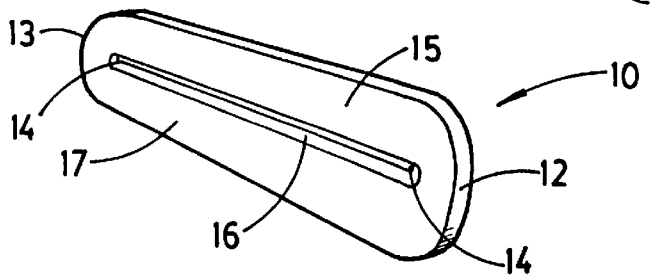
FIG. 3 is a perspective view of FIG.1.
Figure 4:
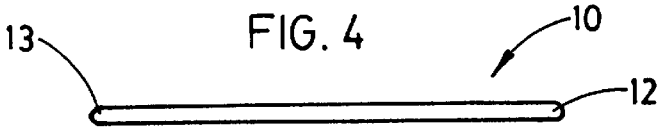
FIG. 4 is a top plan view of FIG. 1.
Figure 5:
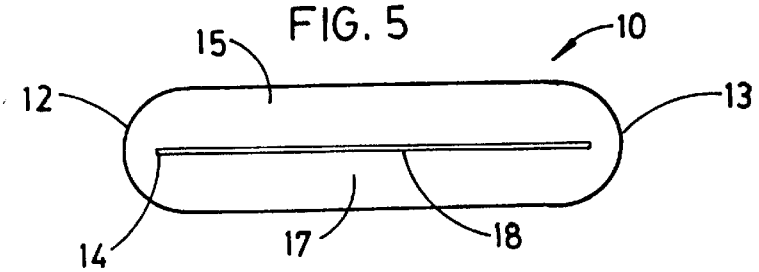
FIG. 5 is a rear elevational view of FIG. 1.

As most clearly shown in FIGS. 1, 3 and 5, the slot has a wider entrance opening or mouth 16, and a narrower inner portion or knife-like scraping rear edge, or rear exit 18. This narrower exit or inner portion 18, must be of a specific width, and preferably no wider than the thickness of two walls of a flexible plastic tube (shown at 20 in FIG. 6). Extensive studies and testing have shown that the slot should be about 0.020 inches wide. Such a slot has been shown to works best with todays' flexible, plastic, walled tubes having seams therein.

Figure 6:
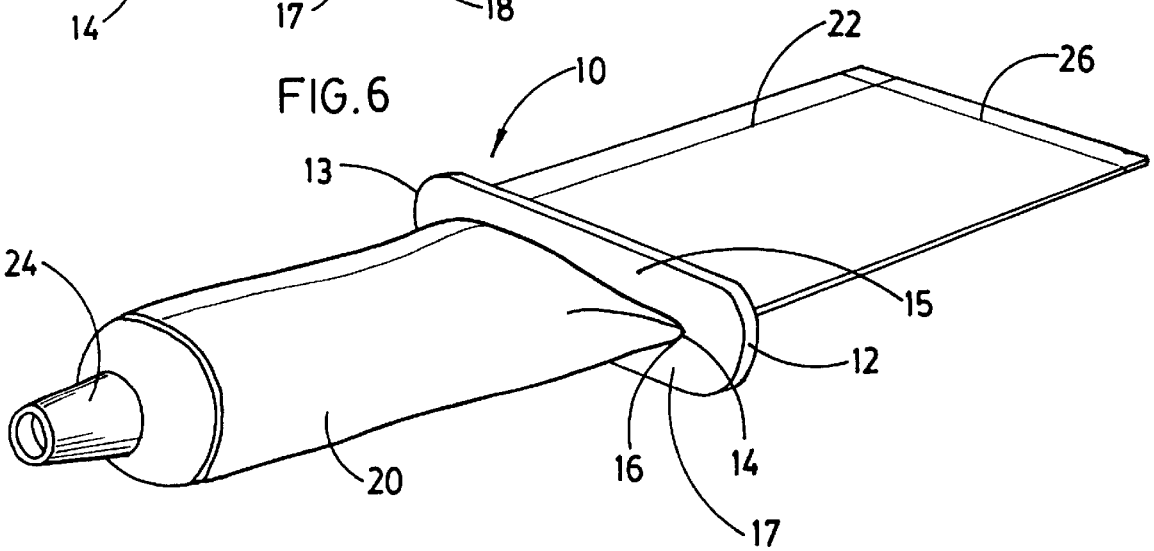
FIG. 6 is a perspective view of a flexible tube having an overlapping, sealed seam with the extrusion device of the present invention shown thereon, in a position where it has squeezed approximately one half of a viscous material, such as toothpaste, from the dispensing end of the flexible tube.

Most modern plastic, flexible walled tubes 20, such as shown in FIG. 6, include an overlapping, longitudinally sealed seam, such as at 22. This sealed seam 22 creates a higher area or ridge on the tube, due to the additional wall thickness at the point of overlap of the walls of the-tube. As is well known, the flexible, resilient tube 20 includes a cap 24, or the like, that must be removed to dispense material therefrom and a flattened, embossed and sealed end 26. The flattened, embossed and sealed end 26 is also normally thicker than two wall thicknesses.

In use, the flexible device 10 of the present invention is firmly grasped by the fingers of a user at one of the rounded ends 12 or 13. The slot 14 is then placed, at an angle, over one end of the flattened and sealed end 26 of tube 20. That is, the larger mouth, or opening 16 of the slot 14, is preferably placed at an angle to one corner of the sealed end 26, so as to enable the entire device 10 to be pushed onto the end of the tube, over the larger or thicker sealed end 26. As discussed above, the device 10 is sized and dimensioned so that it fits on any available flexible tube and so as to enable the slot 14 to flex or become enlarged so that the device may be slipped over the sealed end 26 of a flexible tube until it is aligned on the tube 20 with substantially no play at the ends of the slot. The slot is preferably approximately 0.020 inches wide and of sufficient flexibility and length to accommodate the entire width of sealed end 26 and the walls of the tube 20, when substantially flattened. That is the flattened tube 20, including the seam 22 fits snugly in the slot 14, without any play therein. And, since the device 10 is resilient enough to allow the side edges 15 and 17 to flex, this enables the device 10 to be smoothly slid over the end 26 and then slid along tube 20, toward the cap 24, to enable the sides of the tube to be flattened. The slot 14 has a spring-like, clamping action against the flexible seamed and plastic tube inserted therein, to allow the device to flatten the tube 20 and move any viscous product therein forward toward the dispensing end, and also to hold the flexible device in position on the tube 20, while viscous material in the flexible tube is dispensed by manually squeezing the remaining filled portion of the tube 20, toward the dispensing end.

Accordingly, as will be apparent to those skilled in the art, the device of the present invention provides an easy to use and handle extrusion aid for emptying a flexible, plastic tube, and particularly, a plastic, flexible tube having a seam thereon.

Those skilled in the art will appreciate that various adaptations and modifications of the just-described, preferred embodiments, can be completed without departing from the scope and spirit of the invention. Therefore, it is to be understood, that within the scope of the appended claims, the invention may be practiced other than as specifically described herein.

What is claimed is:

1. A flexible device for aiding in the dispensing of a viscous material from a plastic, flexible walled tube, having an overlapping, longitudinal seam creating a ridge thereon; the tube having one flattened and sealed end, and a second dispensing end having a closure means thereon; the flexible device comprising, in combination:

a flexible, generally planar, elongated body having a slot of a shorter length than the body formed through the body;

the slot having a wider entrance into the body and a narrower exit from the body substantially equal to the width of two walls of the seamed plastic tube inserted therein; the slot tapering to a knife-like scraping rear edge;

the wider entrance into the slot adapted to receive the flattened and sealed end of the flexible plastic tube; and the flexible device being made from a material so that the slot has a spring-like clamping action against the flexible seamed and plastic tube inserted therein, to allow the slot to pass over the flattened and sealed end and the thicker seamed portion of the plastic tube flexible body, so as to flatten the flexible tube and move viscous product therein forward, toward the dispensing end of the flexible tube, and the flexible device being held in position by the knife-like scraping rear edge, while the viscous material remaining in the flexible tube is dispensed by manually squeezing the flexible tube to move any remaining viscous material toward the forward end of the flexible tube.

2. The flexible device of claim 1 wherein the flexible device is substantially rectangular and approximately one eighth of an inch thick, between about ⅝ of an inch and ¾ of an inch wide, and between two and three quarters inches and two and fifteen sixteenths inches long.

3. The flexible device of claim 2 wherein the slot is approximately 2 and three eights inches long.

4. The flexible device of claim 1 wherein the flexible device is sized and dimensioned to fit over the flattened and sealed end of substantially any size plastic, flexible walled tube.

5. A flexible device for dispensing a viscous material from a flexible walled tube having a longitudinal seam formed creating a ridge along a length of the flexible walled tube, comprising:

the flexible walled tube being formed from plastic and having a flattened, embossed and sealed end and, a dispensing end having a nozzle with a closure means thereon;

the flexible device being fabricated from a plastic so as to be substantially rectangular with rounded outer ends and elongated, flexible side portions with a slot formed between the elongated, flexible side portions and the rounded ends;

the slot having a wider entrance into the flexible device and tapering through the flexible device to form a narrower knife-like rear scraping exit to enable the flattened, embossed and sealed end of the flexible walled tube to be inserted therein, and cause the slot to be moved due to the resilience of the material from which the flexible device is made, and to be held in position on the flexible walled tube by the narrower knife-like rear scraping edge.

6. The flexible device of claim 5 wherein the flexible device is sized and dimensioned so as to fit over the flexible walled tube in such a manner that the slot varies in width and the knife-like rear scraping edge has a spring-like clamping action on the flexible walled tube to allow the flexible device to be first inserted over the flattened, embossed and seal end, and a thicker sealed seam and to then flatten the flexible walled tube to move any viscous product therein, toward the dispensing end of the flexible walled tube, and to then be held in position on the flexible walled tube by the narrower knife-like rear scraping edge.

* * * * *